United States Patent [19]

Cassé

[11] 3,956,806

[45] May 18, 1976

[54] ROLLER FABRIC FULLING MACHINE

[76] Inventor: Marcel Cassé, 103, Rue Feray, 91100 Corbeil-Essonnes, France

[22] Filed: June 18, 1973

[21] Appl. No.: 370,696

[30] Foreign Application Priority Data

July 10, 1972 France ..... 72.24871

[52] U.S. Cl. ..... 26/20; 28/5; 68/177

[51] Int. Cl.[2] ..... D06C 17/02

[58] Field of Search ..... 28/5; 26/19, 20, 21; 68/177, 178

[56] References Cited

UNITED STATES PATENTS

| | | | |
|---|---|---|---|
| 64,049 | 4/1867 | Walber | 28/5 |
| 2,093,709 | 9/1937 | Cassé | 28/5 |
| 2,506,855 | 5/1950 | Cassé | 28/5 X |
| 2,632,229 | 3/1953 | Mezzera | 28/5 |
| 2,683,299 | 7/1954 | Cassé | 28/5 |

FOREIGN PATENTS OR APPLICATIONS

| | | | |
|---|---|---|---|
| 163,150 | 12/1964 | U.S.S.R. | 26/21 |
| 240,229 | 9/1925 | United Kingdom | 28/5 |

*Primary Examiner*—Robert R. Mackey
*Attorney, Agent, or Firm*—Holman & Stern

[57] ABSTRACT

The fulling machine comprises a plurality of pairs of rollers in facing relation to each other and movable relative to each other and defining therebetween a passage and pinching gap. At least one of the rollers of each pair of rollers undergoes a cylindrical movement which varies both the width of the gap and the relative position of the two rollers in a direction perpendicular to the gap and to the axis of the roller.

It is particularly advantageous in the fulling of felt pieces.

10 Claims, 8 Drawing Figures

ROLLER FABRIC FULLING MACHINE

The present invention relates to the fulling of fabrics manufactured from animal fibers. For this purpose, three types of machines are known, namely the milling stock machine, the cylinder fulling machine and the multiroller fulling machine.

The milling stock machine has as drawbacks a deformation of the fulled pieces, loss of fibers and defects and in particular an uneven surface.

The cylinder fulling machine in which the piece to be fulled passes between two cylinders and then into a passage whose section progressively decreases, also has as drawbacks, apart from defects and a high consumption of driving power due to friction, losses by abrasion of the wool fibers which are the most expensive, these fibers having migrated in the course of the fulling to the exterior of the fabric so as to cover the other, synthetic or natural fibers of this fabric.

In multiroller fulling machines, which have only been employed heretofore in the fulling of unwoven felt, the piece to be fulled passes between at least two beds of opposed rollers to which are imparted firstly, a continuous rotation which drives the piece between the rollers, and, secondly, in respect of at least one bed, movements of rapid small-amplitude oscillations or vibrations termed beats which are directed either along the axes of the rollers, or along their circumference, or in both of these directions, and which, in the case where the two beds of rollers undergo such beats, are in respect of these two beds of the same amplitude and frequency but shifted in phase 180°, or an angle adjustable between 0° and 180°, or of different amplitudes and frequencies and, thirdly, a movement of oscillation about their axes of a larger amplitude than the foregoing but in phase in opposed rollers, which causes the piece to advance in a slow step-by-step motion. The fulling action is promoted, on one hand, by the presence of flutes or grooves, teeth or other sculptured portions which are hollow or project, formed on the outer surface of the rollers and different from one roller to the other and, on the other hand, by a crowding, or progressive reduction in the speed of rotation of the successive rollers, the rate of this crowding or cramming, which was heretofore constant, being however necessarily moderate so as to avoid permanently forming corrugations. These fulling machines produce a felt of higher quality than the prior felts, with lower losses of fibers and at a relatively high production rate.

An object of the present invention is to provide a multiroller fulling machine which operates much more rapidly than the known machines, avoids their various drawbacks and produces a fulled fabric of higher quality.

The invention provides a multiroller fulling machine of the type comprising at least one pair of rollers disposed in facing relation and movable relative to each other and forming therebetween a passage and pinching gap, wherein at least one of the rollers undergoes a movement which both varies the width of said gap and the relative position of the two rollers in a direction different from that of the variation in the width of the gap.

Preferably, the movement is such that the line of said roller which defines the gap describes a closed surface. In a particularly advantageous embodiment, this surface is cylindrical and of circular section, that is to say, the axis of said roller revolves about a fixed axis parallel thereto, the distance between the two axes remaining constant.

Further features and advantages of the invention will be apparent from the ensuing description with reference to the accompanying drawings.

Figures 1, 2, 3, 6:
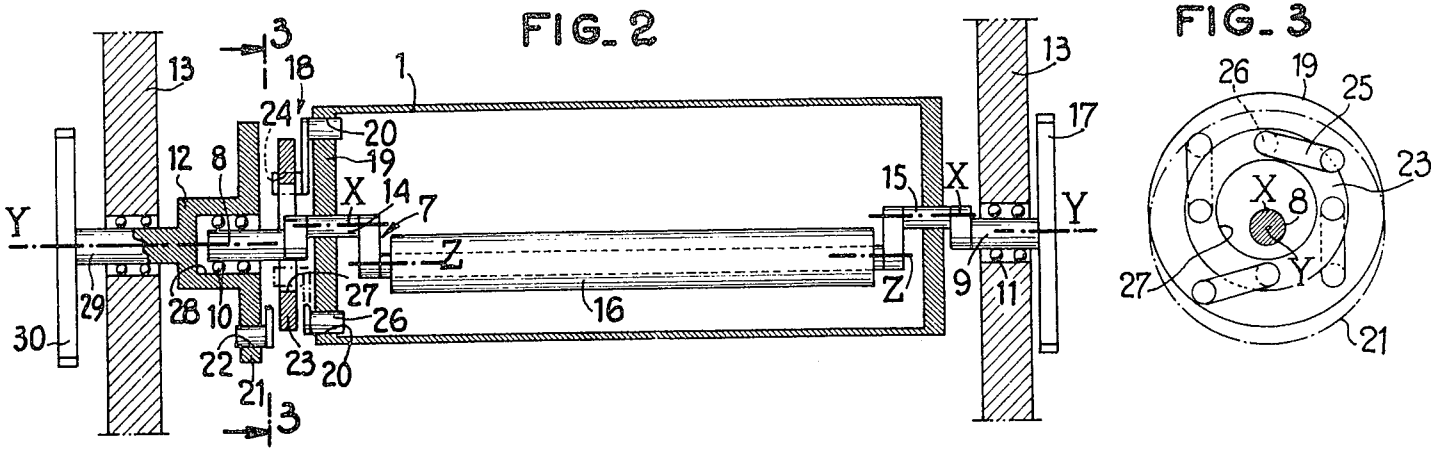
FIG. 1 is a diagrammatic representation of the movement imparted to a roller of a multiroller fulling machine in accordance with the invention.
FIG. 2 is a diagrammatic axial sectional view of the assembly of a roller which undergoes a movement according to the invention.
FIG. 3 is an end elevational view, in the direction of arrows 3—3 of FIG. 2, the assembly being turned through 45° about the axis Y—Y with respect to the arrangement shown in FIG. 2.
FIG. 6 is an enlarged cross-sectional view of a detail of the machine shown in FIG. 5 taken on line 6—6.

As seen in FIG. 1, a roller 1 having an axis X—X is disposed adjacent a roller 2 in such manner that they define a fabric passage and pinching gap 3. The axis X—X is made to revolve about a fixed axis Y—Y so as to describe a cylinder around the latter. Any generatrix of the roller 1, and in particular the generatrix 5 which defines the gap 3, also describes a cylinder 6 of the same dimension as the cylinder 4. This cylindrical movement of the generatrix 5 indeed produces a very considerable fulling action on the pieces which are caused to pass through the gap 3, as will be explained in more detail hereinafter.

The roller 1 shown in FIGS. 2 and 3 comprises a tube of stainless steel on axis X—X which is mounted to rotate freely and in an eccentric manner on a crankshaft 7 having an axis Y—Y. This shaft has two end cylindrical bearing portions 8 and 9 which are centered on the axis Y—Y and are mounted inside two rolling bearings 10 and 11 of which one bears on a member 12 mounted on the frame 13 and the other bears directly on the frame 13. The shaft 7 has moreover two bearing portions 14 and 15 which are both eccentric with respect to the axis Y—Y and aligned on the same axis X—X. These eccentric bearing portions carry rolling bearings on which there are journalled end plates which close the tube. The part 16 of the shaft between the bearing portions 14 and 15 constitutes a counterweight with respect to the axis Y—Y for the weight of the eccentric bearing portions 14 and 15 and all the parts supported thereby, namely the roller, the rolling bearings of the roller and eccentric parts of the transmission means described hereinafter. This part 16 is constituted by a cylinder having an axis Z—Z which is eccentric with respect to the axis Y—Y, parallel to the latter and diametrally opposed to the axis X—X.

The crankshaft 7 is driven in rapid rotation through a gear 17 fixed to the end of the bearing portion 9 and receiving its motion from a transmission which will be described hereinafter. The roller is driven in rotation at a lower speed through a deformable coupling which transmits a movement of rotation about the axis Y—Y to the assembly, having the eccentric axis X—X, comprising the roller 1 and the bearing portions 14 and 15.

This coupling 18 comprises a plate 19 which constitutes the end plate of the roller 1 adjacent the member 12 and in which are formed two diametrally opposed bores 20, a second plate 21 constituted by an end flange of the member 12 and therefore rotating about the fixed axis Y—Y, said second plate carrying also two diametrally opposed bores 22, and, between the plates 19 and 21, a third movable plate 23 which has the shape of a ring and includes, at equal distances from the center of the plate 23, four bores 24 which are arranged in pairs on two diameters perpendicular to each other and diametrally opposed in each pair. A pair of identical links 25 is located on each side of the movable plate 23 and is each constituted by a rectangular body which carries two journals 26, one on each side of the link. The distance between the bores 24 and the center of the plate 23 is equal to *d*, the distance between the bores 20 and 22 and the center of the plates 19 and 21 is equal to $\sqrt{2 \cdot d}$ and the axes of the two journals 26 of each link 25 are at a distance *d* from each other. One of the journals 26 of each link is journalled in one of the four bores 24 of the movable plate 23 whereas its other journal 26 is journalled in a bore of the plate 19 or 21.

This assembly constitutes a coupling similar to an Oldham coupling, the assembly of two links 25 located on the same side of the plate 23 constituting a Watt parallelogram. The center of the movable plate moves between rather wide limits on a curve which may be considered to be very approximately a straight line, the guiding of the movable parts by the links being thus very near to that which is achieved in an Oldham coupling. The transmission is slightly irregular, but this irregularity, which results in no practical inconvenience, is even beneficial to the fulling action. The advantage of such a coupling is that the sole mechanical frictions are the small amplitude oscillations of the journals 26 of the links 25 in the bores of the three plates. This friction is insignificant compared to those existing in an Oldham joint.

The circular center aperture 27 of the ring which constitutes the movable center plate 23 has such diameter as to allow the crankshaft 7 to pass therethrough and allow the movement of the movable plate 23. This aperture 27 reduces the weight, and consequently the inertia, of the movable plate 23. The rolling bearing 10 which receives the end bearing portion 8 of the shaft is contained in a center housing 28 of the member 12 which extends from the end of the member remote from the plate 22 in the form of a shaft portion 29 having an axis Y—Y and journalled in the frame 13. The shaft portion 29 carries at its end a gear 30 which is driven in rotation by a mechanism which will be described hereinafter.

Figure 4:
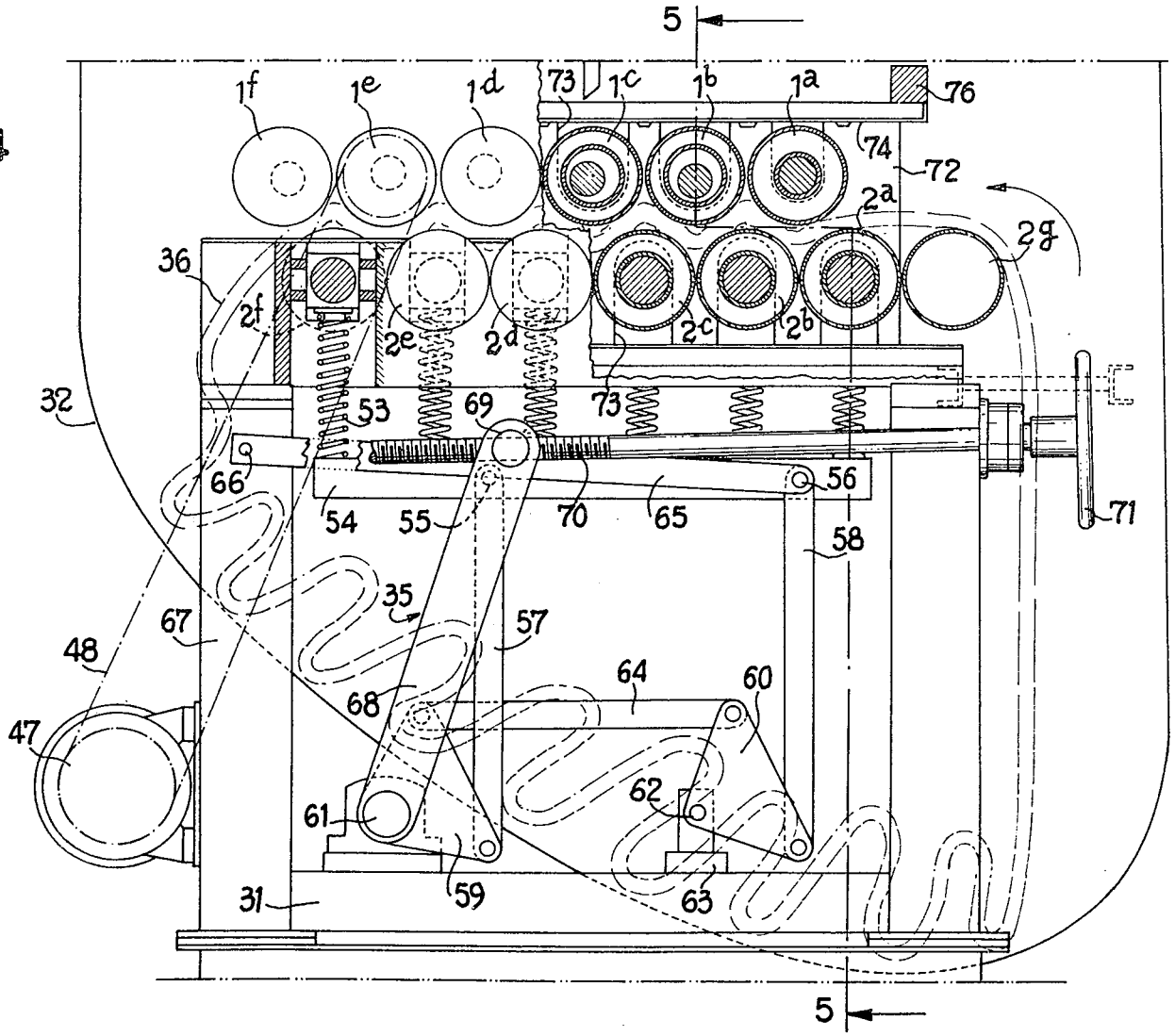
FIG. 4 is an elevational view, with parts shown in section, of a fulling machine according to the invention.
Figure 5:
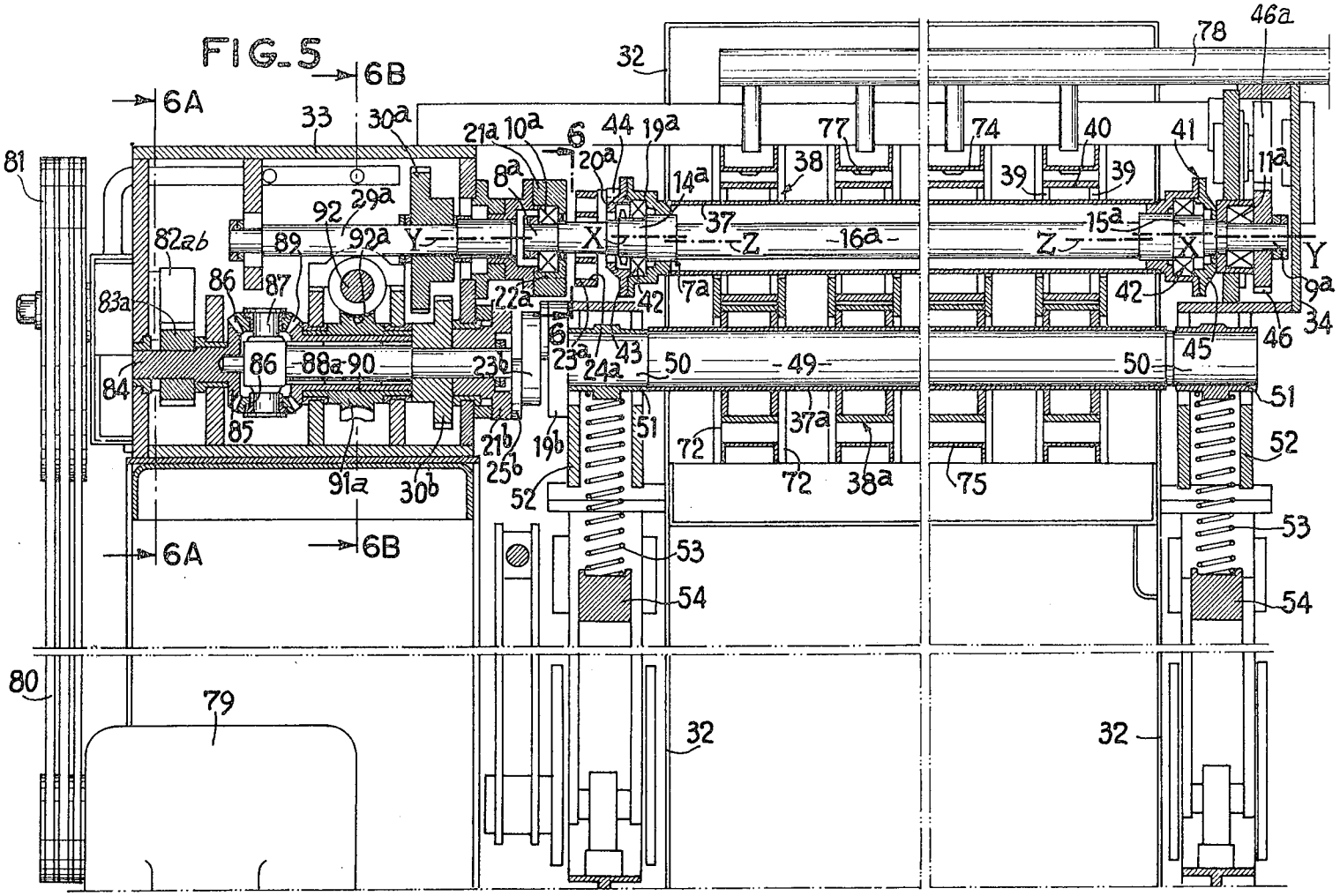
FIG. 5 is a cross-sectional view taken on line 5—5 of the machine shown in FIG. 4.

The multiroller fulling machine shown in FIGS. 4 and 5 has a stand 31 on which bears a vessel 32 in which are disposed two horizontal beds of rollers, each bed having six rollers 1*a* to 1*f* and 2*a* to 2*f*. On one side of the vessel there is provided a gearbox 33 which transmits to the rollers the continuous movement of rotation whereas on the other side of the vessel there is provided a second gearbox 34 which transmits solely to the upper rollers 1*b* to 1*f* the oscillatory movements. On each side of the two vertical longitudinal walls of the vessel which separate the two gearboxes, there is also disposed a mechanism 35 which allows the lower rollers 2*a*–2*f* independent vertical displacements and presses these lower rollers against the upper rollers with an adjustable force.

The two beds of rollers are disposed horizontally one above the other, the rollers of the same bed being disposed in such manner as to come substantially in contact with each other and the two beds being offset so that in the assembly of the rollers there is a staggering of half a diameter between a roller of one bed and the following roller of the other bed, each roller having thus two generatrices substantially in contact with two rollers of the opposed bed so that the fabric 36 to be treated travels through an undulatory path between the roller which promotes the fulling effect. A roller 2*g* rotates freely on two bearings and turns the piece to be fulled coming from the bottom of the vessel before its passage between the operative rollers.

The rollers and all the parts of the machine which must come in contact with the fabric or the fulling bath are of stainless steel. Each roller of the rollers 1*b* to 1*f* is constituted by a center tube 37 on which are mounted five drums 38 which permits fulling simultaneously five pieces of fabric. Each of these drums consists of two side walls 39 which are circular rings welded to the center tube and interconnected by a portion of tube 40 on the outer surface of which are recessed different sculptures adapted to drive the piece of fabric and amplify the fulling action of the roller. The center tube 37 of each roller 1*b*–1*f* is welded at its two ends outside the vessel 32 to rolling bearing boxes 19*a* and 41 containing rolling bearings 42, the inner rings of which are fixed to eccentric bearing portions 14*a* and 15*a* of a shaft 7*a* which rotates with clearance in the center tube 37 and is journalled by two end bearing portions 8*a* and 9*a* in two rolling bearings 10*a* and 11*a* having a fixed axis Y—Y. This shaft 7a includes, in addition to the end bearing portions 8*a* and 9*a* which are centered on the fixed axis Y—Y and the two eccentric bearing portions 14*a* and 15*a* having an axis X—X parallel to the axis Y—Y, an eccentric cylindrical center part 16*a* whose axis Z—Z is parallel to the fixed axis Y—Y and diametrally opposed, with respect to the axis Y—Y, to the axis X—X of the eccentric bearing portions 14*a* and 15*a*. Throughout the ensuing description the elements which carry an index *a* in addition to the reference numeral correspond to elements of the same reference numeral without the index *a* of the mechanism shown in FIGS. 2 and 3.

Fixed to the bearing box 19*a* is a cover 43 including two diametrally opposed bosses 44 in each of which a bore 20*a* receives a journal 26*a* of a link 25*a* which has on its other side a second journal 26*a* which is journalled in a bore 24*a* of a ring 23*a*. On the other side of the ring and oriented at 90° with respect to the two links 25*a*, there are two other links 25*a* which are pivoted, on one hand, in two bores 22*a* formed in a plate 21*a* mounted on the end of a shaft 29*a* which is journalled in a gear box 33 and is driven by a gear 30*a* of this gearbox which is keyed thereto. At the other end of the roller, the bearing box 41 welded to the center tube 37 is closed by a circular cover 45. The outer ring of the bearing 11*a* which receives the bearing portion 9*a* of the shaft centered on the axis Y—Y is supported by the gearbox 34 and the end of the bearing portion 9*a* carries a gear 46 which pertains to a gear train associating all the corresponding gears of the upper rollers 1*a*–1*f*. This gear train comprises : the gears 46, idler gears which mesh between and interconnect pairs of adjacent gears 46 and one intermediate gear which is integral with a spindle which carries a pulley driven by a motor 47 through belts 48.

Each of the lower rollers 2*a*–2*f* is constituted, as are the upper rollers, by stainless steel drums 38*a* welded to a center tube 37*a*. This center tube is completely filled by a solid cylindrical bar 49 of ordinary steel. This steel bar imparts great strength to the rollers but above all acts as an anvil on which the fabric bears. It therefore enhances the efficiency of the oscillations of the upper rollers. It has at each of its ends a cylindrical bearing portion 50 which is supported and journalled in a bearing 51 vertically guided between two vertical cross-members 52. Each of the bearings 51 is subjected in its lower part to the action of a spring 53 which bears on a square-sectioned cross-member 54 extending in a generally horizontal direction transversely of the direction of the rollers. Each cross-member carries two pins 55 and 56 to which two vertical links 57 and 58 are pivoted. At their lower end, the links 57 and 58 are pivoted to two levers 59 and 60 which are pivotable about two axes, one of which axes is that of a large-section rotatable shaft 61 extending through the machine and parallel to the rollers and rigidly interconnecting the two levers 59 situated on opposite sides of the vessel, the second axis being of a shaft 62 carried by a support 63 secured to the bed 31 of the machine. The levers 59 and 60 on each side of the machine are interconnected by a horizontal connecting rod 64 whose length equals the distance between the shafts 61 and 62. These two levers raise or lower the corresponding cross-member 54 while maintaining it horizontal. Another connecting rod 65, substantially horizontal and of great length, is pivoted at one end to the pin 56 secured to the cross-member 54 and at the other end to a fixed pin 66 carried by a post 67 pertaining to the frame of the machine. The movable end of this connecting rod 65 which drives the cross-member 54, describes an arc of a circle about a means horizontal position but, owing to the small size of the included angle this arc may be considered to be substantially a vertical straight line. Consequently, the cross-members 54 move substantially vertically while remaining horizontal. Secured at one end of the shaft 61 is a lever 68 to the end of which is pivoted a nut 69 in which a lead-screw 70 is screwthreadedly engaged. This lead-screw rotates at one end in a spherical abutment contained in a box fixed to the frame of the machine and it carries a wheel 71 whereby it can be rotated so as to swing the lever 68 and rotate the shaft 61 which pivots the levers 59 and 60 and thus shifts the cross-member 54 vertically through the connecting rods 57 and 58 on each side of the machine.

Two vertical and parallel plates 72 are disposed against and outside the two pairs of side walls 39 of each pair of drums 38 and 38*a* with minimum clearance so that the drums may be free to move between these plates. The plates 72 have openings 73 so that the rollers can be placed in position and moved and they are constituted preferably by stratified panels of fabric impregnated with synthetic resin such as bakelite (phenol-formol). These panels have the advantage of having a very low coefficient of friction in the presence of water if they come in contact with the stainless steel of the side walls 39. These pairs of plates 72 are each fixed to two U-shaped members 74 and 75, the members 74 being located in the upper machine part and the other members 75 in their lower machine part. The upper members 74 are each secured at the ends to bars 76 constituting braces between the various sub-assemblies of the machine. The upper members 74 have in their horizontal webs perforations 77 which are in vertical alignment with the gaps between the different upper rollers and through which a fulling or washing liquid, circulated by a pump and conveyed by piping 78, is distributed between the upper rollers on the piece in the course of fulling or washing by troughs constituted by said upper members 74.

Figure 6A:
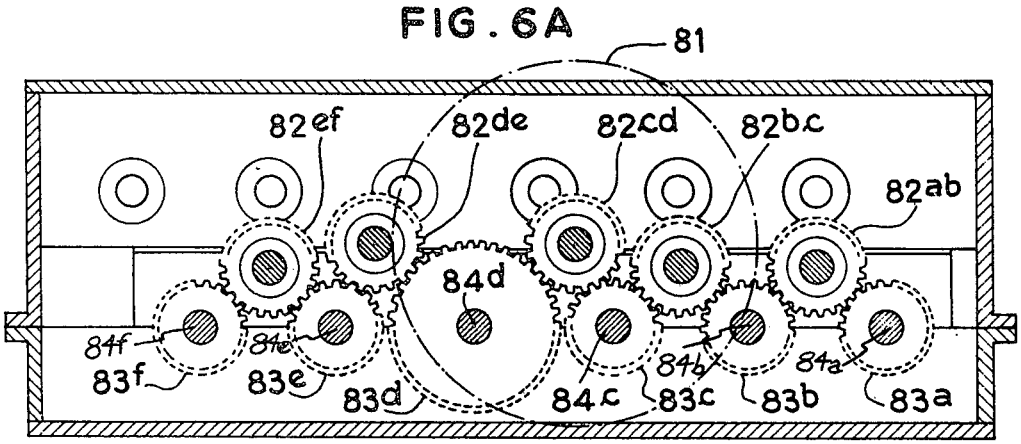
FIG. 6A is a sectional view taken on line 6A—6A of FIG. 5.
Figure 6B:
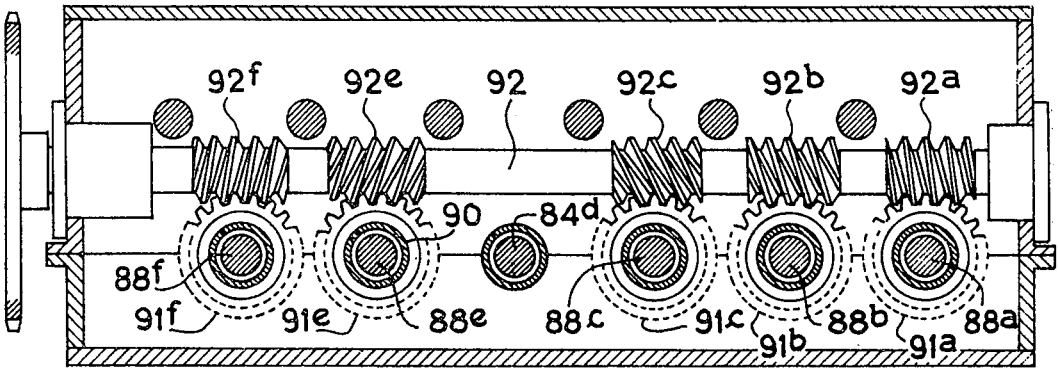
FIG. 6B is a sectional view taken on line 6B—6B of FIG. 5.

With reference to FIGS. 5, 6A and 6B, a motor 79 drives, through belts 80, a pulley 81 whose shaft carries a gear 82*cd* which transmits its movement of rotation to the six lower rollers 2*a* to 2*f* through a train of gears having parallel axes. The gear 82*cd* meshes with two other gears 83*c* and 83*d* fixed to two shafts 84*c* and 84*d* pertaining to an assembly of six shafts aligned with the different rollers 2*a* to 2*f*, the two shafts 84*c* and 84*d* which carry these gears 83*c* and 83*d* being those which are aligned with the rollers 2*c* and 2*d*. Each shaft 84*a*, 84*b*, 84*c*, 84*e* and 84*f* respectively aligned with the rollers 2*a*, 2*b*, 2*c*, 2*e* and 2*f* carries a driving gear 83*a*, 83*b*, 83*c*, 83*e* and 83*f* and the latter five gears are identical. Only the shaft 84*d* corresponding to the roller 2*d* carries a driving gear 83*d* the number of teeth of which is double the number of teeth of the five other driving gears 83*a*, 83*b*, 83*c*, 83*e* and 83*f* for reason explained hereinafter. Idler gears 82*ab*, 82*bc*, 82*de*, 82*ef*, freely rotatable on their spindles, operatively interconnect all the driving gears 83*a*, 83*b*, 83*c*, 83*d*, 83*e* and 83*f* so that they rotate at the same speed and in the same direction. The shafts 84*a*, 84*b*, 84*c*, 84*e* and 84*f* corresponding to the rollers 2*a*, 2*b*, 2*c*, 2*e* and 2*f* each carry a bevel gear 85 which is meshed with two bevel gears or planet gears 86 which are freely rotatable on the ends of a transverse shaft 87 integral with another shaft 88*a*, 88*b*, 88*c*, 88*e* and 88*f* which is aligned with the corresponding shaft 84*a*, 84*b*, 84*c*, 84*e* and 84*f*. At its other end, each shaft 88*a*, 88*b*, 88*c*, 84*e* and 84*f* carries a plate 21*b* which, completed by four links 25*b*, a ring 23*b* and a second plate 19*b* fixed to the end of the corresponding lower roller, constitutes a coupling similar to that described for driving the upper rollers and which transmits the movement of rotation of the shaft to the lower roller irrespective of the position of the latter when it moves vertically. The two gears 86 mesh with a bevel gear 89 which is carried by a hollow shaft 90 coaxial with one of the corresponding shafts 88*a*, 88*b*, 88*c*, 88*e*, 88*f*. The assembly comprising the two bevel gears 86, bevel gear 89 and the gear 85 constitutes a conventional differential system.

The shaft 84*d* corresponding to the lower roller 2*d* is directly integral with a plate 21*b* which drives this roller 2*d* without the intervention of a differential 85-86-89 (see FIG. 6B).

A worm wheel is integral with each of the hollow shafts 90. Thus worm wheels 91*a*, 91*b*, 91*c*, 91*e* and 91*f* pertain to the rollers 2*a*, 2*b*, 2*c*, 2*e* and 2*f*, respectively, and mesh with worms 92*a*, 92*b*, 92*c*, 92*e* and 92*f*, respectively machined in a shaft 92. All the worm wheels have the same number of teeth but the inclination of their teeth relative to their axes depends on the number of threads of the worm with which they mesh. The worms comprise (FIG. 6B) respectively three right-hand threads (worm 92*a*), two right-hand threads (worm 92*b*), a single right-hand thread (worm 92*c*), a single left-hand thread (worm 92*e*) and two left-hand threads (worm 92*f*). Not only is there no differential 85-86-89 for the roller 2*d* but there is no worm wheel 91 nor corresponding worm, but there is on the shaft 92 a smooth bearing portion which is journalled in a bearing fixed to the box. The shaft 84*d* which directly drives the roller 2*d* rotates at a speed which is one half that of the other shafts since its driving gear 83*d* has twice as many teeth as the other driving gears 83*a*, 83*b*, 83*c*, 83*e*, 83*f*. Now, the speed of rotation of each planet gear carrying shaft 88*a*, 88*b*, 88*c*, 88*e* and 88*f* is also one half of that of the corresponding shaft 84*a*, 84*b*, 84*c*, 84*e* and 84*f* when the corresponding second bevel gear 89 is stationary. This means that all of the lower rollers 2*a*, 2*b*, 2*c*, 2*e* and 2*f* rotate at the same speed as the roller 2*d* when their respective differentials remain stationary, that is to say when the shaft 92 does not rotate. This shaft 92 is driven through a speed reducer by a motor (not shown). Under the effect of the threads of the worms 92*a*, 92*b*, 92*c*, 92*e* and 92*f* when the shaft 92 rotates, it drives the wheels 91*a*, 91*b*, 91*c*, 91*e* and 91*f* at speeds having the following speed ratios : +3, +2, +1, −1 and −2, respectively. The differentials permit adding algebraically these speeds to those of the gears 85. The speeds of rotation of the rollers 2*a*, 2*b*, 2*c*, 2*e*, 2*f* thus vary gradually from the input (right side of FIG. 4) to the output of the machine. By varying the speed of the shaft 92, the speeds of all the rollers 2*a*, 2*b*, 2*c*, 2*e* and 2*f* may also be varied together as desired. Depending on the direction of rotation of the shaft 92, the crowding may be positive, that is to say, the speed of rotation of the rollers decreases gradually from the input to the output but, by reversing the rotation of the motor driving the shaft 92, it is also just as easy to produce a gradual increase in the speeds from the input to the output of the machine, that is to say, a stretching of the piece. This effect has some importance in practice since it enables the final length of the piece being treated to be adjusted.

The shafts 88*a*, 88*b*, 88*c*, 88*e* and 88*f* associated with the lower rollers 2*a*, 2*b*, 2*c*, 2*e* and 2*f* and the shaft 84*d* associated with the lower roller 2*d* are each integral with a gear 30*b* which is meshed with a gear 30*a* fixed to a shaft 29*a* which rotates the neighbouring upper roller. The gears 30*a* and 30*b* of the same pair of gears have numbers of teeth which differ slightly from each other so as to compensate for the effect of the driving (or of the driving back depending on the direction of rotation) of the fabric brought about by the oscillating movement in a circular path of the upper rollers or to produce a slight difference of speed between the lower rollers and upper rollers so as to shift the positions of the folds in the piece in the course of fulling and to accentuate the unfolding effect. The pairs of rollers operatively interconnected by the gears 30*a* and 30*b* are the following : 1*a*–2*a*, 1*b*–2*b*, 1*c*–2*c*, 1*d*–2*d*, 1*e*–2*e* and 1*f*–2*f*. The gears 30*a* and 30*b* of two successive pairs are alternately staggered in the direction of their axes a distance at least equal to the axial extent or thickness of these gears (see FIG. 5).

The rollers 1*a* and 2*a* of the first pair are made to undergo merely a movement of rotation and the two gears 30*a* and 30*b* which interconnect them in this rotation have the same number of teeth. In the following five pairs of rollers : 1*b*–2*b*, 1*c*–2*c*, etc., the upper roller has an oscillating movement in a circular path the frequency of which is determined by the speed of rotation of the center eccentric shaft 7*a*. The order of magnitude of this speed is 1,500 rpm and that of the amplitude of the movement 4 mm. The speed of rotation of each of the rollers of a pair results in the speed of passage of the fabric which is from 120 to 200 meters per minute. This speed varies gradually from one pair to the other under the action of the crowding mechanism.

The fulling machine just described operates in the following manner :

The piece of fabric or cloth 36 to be fulled is arranged into loops, its edges are sewn, an it is engaged between the two beds of rollers. The two ends of the piece are then stitched together and the motors of the fulling machine started up.

The piece is perfectly well driven along be eleven generatrices of contact between the rollers and it extends around approximately one sixth of each roller. This is an appreciable advantage relative to cylinder fulling machines between the cylinders of which sliding and stoppage of the piece may cause damage. This efficient driving of the piece enables a higher passage speed to be adopted.

The piece remains in the form of loops or undulations between the two plates 72 which have a constant distance therebetween. The piece therefore has numerous folds in its width and this produces a fulling action on the weft threads and a shrinking action on the width of the piece.

After passage and compression between a pair of rollers, the piece arrives in a space having a curvilinear triangular section between three consecutive rollers, one of one bed and the other two of the other bed. It must be engaged between the following pair of rollers but this pair rotates at a lower sped owing to the action of the crowding device which is easy to regulate during operation of the machine. The part of the piece located in the aforementioned space is therefore folded and compressed to an extent which depends on the chosen crowding rate and also on the pressure exerted by the springs 53 which raise the lower rollers. Thus, for a given speed of passage, the fulling effect due to the compression between two rollers followed by the driving of the folds back into a decreasing space occurs ten times in the presently described fulling machine whereas it occurs only once in a cylinder fulling machine.

The gradual variation in the speeds of the pairs of successive rollers constantly produces changes in the position of the folds of the piece and enables fulling defects to be avoided. The slight differences in the speeds between certain opposed rollers accentuate still more this unfolding effect.

Added to this effect of the aforementioned variation are the extremely important fulling effects produced by the high-frequency oscillations in a circular path which the five upper rollers 1*b*–1*f* undergo. These oscillations produce on the piece periodic compressions which are very similar to those which would be produced by a milling stock device at the moment when the mallets arrive at the end of their travel. These five upper oscillating rollers have nine generatrices in contact with the lower rollers and if the eccentric shafts 7*a* which produce these oscillations rotate at a speed of 1500 rpm, there are produced on the piece, between these generatrices and the corresponding lower rollers 2*a* to 2*f*, 13,500 compressions per minute, that is to say about 100 to 150 times those which would be produced in a milling stock device. The folds of the piece compressed in the spaces between three rollers undergo the periodic compressions of the upper rollers.

Also added thereto is the fulling effect due to tangential components created by the oscillating movements of the upper rollers, which components act in the manner of the circumferential oscillations of the rollers of a conventional multiroller fulling machine having five pairs of rollers. This circumferential movement is partially converted into a movement axially of the rollers if helical grooves are formed in the surface of the rollers. This effect is important from the point of view of both the production and the quality of fulling.

The suspension of the two bearings of each lower roller on two springs 53 having a long travel, which ensures the independence of the vertical movements of these rollers and consequently a uniform pressure exerted on the piece, also constitutes a safety precaution against excess local compression of the pieces which could otherwise be due, for example, to the choice of an excessively high crowding rate.

Having now described my invention what I claim as new and desire to secure by Letters Patent is:

1. A multiroller fabric fulling machine comprising a frame, a plurality of adjacent first rollers and a plurality of adjacent second rollers, the first and second rollers being mounted to rotate about their axes relative to the frame, the first rollers being arranged in pairs with the second rollers so that the first roller and second roller in each pair of rollers are capable of defining a pinching gap for the passage of the fabric being fulled, each pair of rollers being relatively movable toward and away from each other, means for rotating the first and second rollers about their axes relative to the frame, means for imparting to the axis of the first roller of at least one of said pairs of rollers a cylindrical movement which movement moves the first roller toward the second roller of said one pair of rollers and varies the relative position of the two rollers of said one pair of rollers in a direction transverse to the axis of said first roller of said one pair of rollers to superimpose periodic oscillations on the rotary movement thereof.

2. A machine as claimed in claim 1, wherein the means for imparting the cylindrical movement to the axis of the first roller includes means for rotating the axis of said first roller of said one pair of rollers about a fixed axis parallel thereto to the axis of said first roller, the distance between the fixed axis and the axis of said first roller being constant.

3. A machine as claimed in claim 1, comprising vertically guided bearings for supporting the second rollers at each end thereof, resiliently yieldable means for biasing the bearings in a direction to bias said second rollers toward said first rollers, and means for regulating the force exerted by the resiliently yieldable means.

4. A multiroller fabric fulling machine comprising a frame, a plurality of adjacent first rollers and a plurality of adjacent second rollers, the first and second rollers being mounted to rotate about their axes relative to the frame, the first rollers being arranged in pairs with the second rollers so that the first roller and second roller in each pair of rollers are capable of defining a pinching gap for the passage of the fabric being fulled, each pair of rollers being relatively movable toward and away from each other, first drive means for rotating the first and second rollers about their axes relative to the frame, at least one of said first rollers being combined with a shaft mounted to rotate relative to the frame about a fixed axis, the shaft having cylindrical bearing portions which are eccentric relative to said fixed axis, said one first roller being rotatably mounted on and concentric with said eccentric bearing portions, and second drive means for rotating said shaft about said fixed axis to superimpose periodic oscillations on the rotary movement thereof.

5. A machine as claimed in claim 4, wherein the first drive means for driving said one first roller in rotation comprises a driving member having the same axis of rotation as the shaft, an articulated coupling being interposed between and operatively interconnecting the driving member and said one first roller.

6. A machine as claimed in claim 5, wherein the articulated coupling comprises an intermediate plate interposed between the driving member and said one first roller, links each having a first journal at one end and a second journal at the other end of the link, some of said links having their first journals journalled in said driving member and their second journals journalled in said intermediate plate and others of said links having their first journals journalled in said intermediate plate and their second journals journalled in said one first roller.

7. A multiroller fabric fulling machine comprising a frame, a plurality of adjacent first rollers and a plurality of adjacent second rollers, the first and second rollers being mounted to rotate about their axes relative to the frame, the first rollers being arranged in pairs with the second rollers so that the first roller and second roller in each pair of rollers are capable of defining a pinching gap for the passage of the fabric being fulled, each pair of rollers being relatively movable toward and away from each other, first drive means for rotating the first and second rollers about their axes relative to the frame, means for mounting the axis of rotation of each first roller of said first rollers to revolve about a second axis which is fixed relative to the frame and parallel to the axis of rotation of said each first roller, the second axis and the axis of rotation of said each first roller being at a constant distance from each other, and second drive means for revolving the axes of rotation of said first rollers about their corresponding second axes to superimpose periodic oscillations on the rotary movement thereof.

8. A multiroller fabric fulling machine comprising a frame, a plurality of adjacent first rollers and a plurality of adjacent second rollers, the first and second rollers being mounted to rotate about their axes relative to the frame, the first rollers being arranged in pairs with the second rollers so that the first roller and second roller in each pair of rollers are capable of defining a pinching gap for the passage of the fabric being fulled, each pair of rollers being relatively movable toward and away from each other, first drive means for rotating the first and second rollers about their axes relative to the frame, means for mounting the axis of rotation of each first roller of said first rollers to revolve about a second axis which is fixed relative to the frame and parallel to the axis of rotation of said each first roller, the second axis and the axis of rotation of said each first roller being at a constant distance from each other, and second drive means for revolving the axes of rotation of said first rollers about their corresponding second axes to superimpose periodic oscillations on the rotary movement thereof said first drive means comprising third means for rotating consecutive second rollers at progressively decreasing speeds from an input end to an output end of the machine so as to produce a crowding effect on said fabric between the first and second rollers.

9. A machine as claimed in claim 8, comprising means for reversing the effect of said third means on the second rollers so as to increase the speeds of said consecutive second rollers and thereby tend to increase the length of the fabric between the first and second rollers.

10. A machine as claimed in claim 8, wherein said first drive means comprise a differential gear system comprising an input first gear member, a second gear member and a planet gear carrier member for each of said second rollers, a drive drivingly connected to said input members of the differential gear systems, each second roller being drivingly connected to said planet gear carrier member of the corresponding differential gear system, said third means being drive means drivingly connected to said second gear member of each differential gear system to rotate said second gear members of the differential gear systems pertaining to said consecutive second rollers at progressively decreasing speeds.

* * * * *